US006609892B1

(12) United States Patent
Kreul et al.

(10) Patent No.: US 6,609,892 B1
(45) Date of Patent: Aug. 26, 2003

(54) PROPELLER HUB

(75) Inventors: Daniel J. Kreul, Winthrop Harbor, IL (US); Michael J. Ewald, Kenosha, WI (US); Philip James McGowan, Grayslake, IL (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/717,626

(22) Filed: Nov. 21, 2000

(51) Int. Cl.[7] ..... B63H 5/125
(52) U.S. Cl. ..... 416/134 R; 416/244 B
(58) Field of Search ..... 416/93 A, 134 R, 416/244 B

(56) References Cited

U.S. PATENT DOCUMENTS 3,589,833 A * 6/1971 Lancioni
3,999,887 A 12/1976 McGuire
4,097,191 A 6/1978 Genuardi
4,507,091 A * 3/1985 Govan
4,566,855 A * 1/1986 Costabile et al. ..... 416/134 R
4,826,404 A * 5/1989 Zwicky
5,184,945 A * 2/1993 Chi-Wei ..... 417/420
5,201,679 A * 4/1993 Velte, Jr. et al. ..... 440/49
5,244,348 A * 9/1993 Karls et al. ..... 416/204 R
5,252,028 A * 10/1993 LoBosco et al. ..... 416/93 A
5,322,416 A 6/1994 Karls et al.
5,476,284 A * 12/1995 DuRocher et al. ..... 280/777
5,484,264 A 1/1996 Karls et al.
5,527,153 A * 6/1996 Bernhardt
5,573,372 A * 11/1996 Badger
5,630,704 A 5/1997 Gilgenbach et al.
5,647,810 A * 7/1997 Huddleston ..... 474/14
5,967,751 A * 10/1999 Chen ..... 416/93 A
6,177,742 B1 * 1/2001 Lauk et al. ..... 310/75 R
6,383,042 B1 * 5/2002 Neisen ..... 440/49

* cited by examiner

*Primary Examiner*—Edward K. Look
*Assistant Examiner*—Ninh Nguyen
(74) *Attorney, Agent, or Firm*—Ziolkowski Patent Solutions Group, LLC

(57) ABSTRACT

A propeller assembly that includes a plastic bushing that is secured, e.g., bonded, to an inner hub and is configured to engage an outer hub of a propeller. More specifically, and in an exemplary embodiment, the bushing includes a cylindrical shaped body having a bore therethrough, and a plurality of grooves are in an outer diameter surface of the cylindrical shaped body. The inner hub includes a cylindrical shaped body sized to extend into the bushing bore. A flange is at one end of the inner hub body, and at least one limp home tab extends from the flange. The propeller includes an outer hub having a cylindrical shaped body, and a plurality of blades extend from an outer diameter surface of the outer hub body. An inner diameter surface of the outer hub body has a plurality of protrusions that extend radially inward. Each protrusion is positioned to extend within a respective one of the grooves in the outer diameter surface of the bushing body. At least one limp home tab extends from the outer hub inner diameter surface.

32 Claims, 3 Drawing Sheets

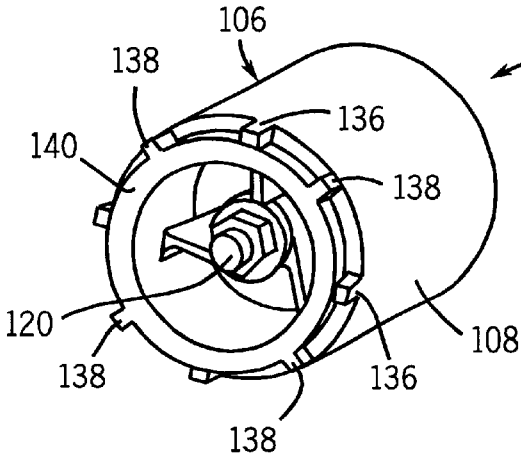
FIG. 3
FIG. 4
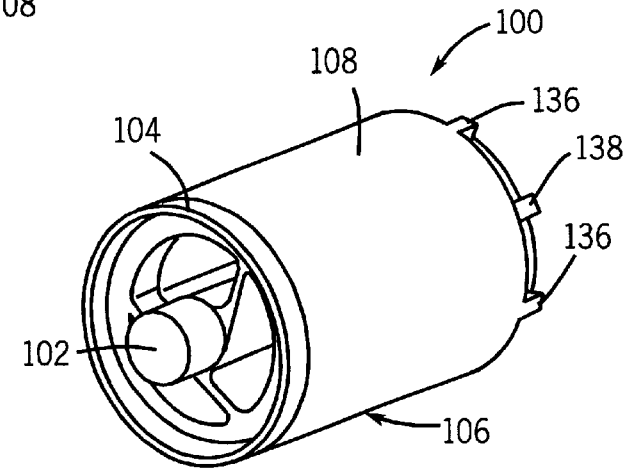
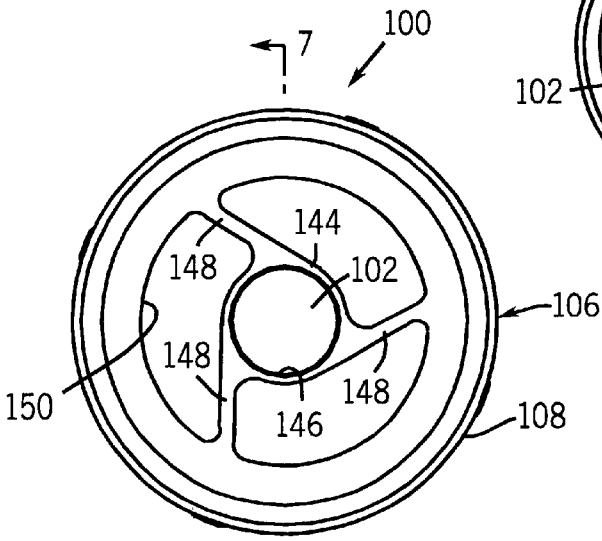
FIG. 5 7
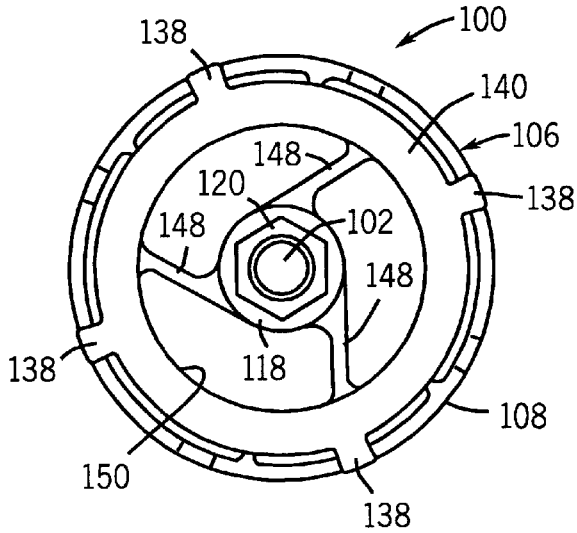
FIG. 6

PROPELLER HUB

BACKGROUND OF THE INVENTION

The invention relates generally to marine engines, and more particularly, to propeller hubs.

Outboard engines include a drive shaft which extends from the engine power head, through an exhaust case, and into an engine lower unit. The lower unit includes a gear case, and a propeller shaft extends through the gear case. Forward and reverse gears couple the propeller shaft to the drive shaft. The drive shaft, gears, and propeller shaft sometimes are referred to as a drive train.

A propeller is secured to and rotates with the propeller shaft. Torque from the engine is transmitted from the propeller shaft to the propeller. Exemplary propeller hub assemblies include cross bolts, keys, shear pins, plastic hubs, and compressed rubber hubs. Such hub assemblies should have sufficient strength or stiffness so that during normal engine operations, very few losses occur between the propeller shaft and the propeller. Such hub assemblies, however, also should be resilient so that the engine drive train is protected in the event of an impact, e.g., if the propeller hits a log or rock.

A propeller hub assembly also should facilitate "limp home" operation of the engine so that even in the event that an interface between the propeller shaft and the propeller shears due to a large impact, the propeller and propeller shaft still remain sufficiently engaged so that the engine still drives the boat, for example, to return to a dock for repairs.

BRIEF SUMMARY OF THE INVENTION

In an exemplary embodiment, a propeller assembly includes a plastic bushing secured, e.g., bonded, to an inner hub and configured to engage an outer hub of a propeller. More specifically, and in an exemplary embodiment, the bushing includes a cylindrical shaped body having a bore therethrough, and a plurality of grooves are in an outer diameter surface of the cylindrical shaped body. The inner hub includes a cylindrical shaped body sized to extend into the bushing bore. A flange is at one end of the inner hub body, and at least one limp home tab extends from the flange.

The propeller includes an outer hub having a cylindrical shaped body, and a plurality of blades extend from an outer diameter surface of the outer hub body. An inner diameter surface of the outer hub body has a plurality of protrusions that extend radially inward. Each protrusion is positioned to extend within a respective one of the grooves in the outer diameter surface of the bushing body. Also, at least one limp home tab extends from the outer hub inner diameter surface.

Generally, the propeller assembly rotates with the propeller shaft during normal operations. In the event of an impact, e.g., the propeller strikes an object in the water, the propeller may rotate relative to the shaft. Specifically, in the exemplary embodiment, since the torsion bushing is plastic and outer hub is stainless steel, the outer hub may rotate relative to the bushing.

In the event that such relative rotation of the propeller results in shearing the engagement between the propeller and the torsion bushing, a limp home arrangement provides that the propeller may still be rotatable with the propeller shaft so that the operator can at least reach a dock for repairs. The limp home arrangement includes the outer hub tabs and the inner hub tabs. Once the propeller outer hub rotates so that the outer hub tabs engage the inner hub tabs, the outer hub once again rotates with the propeller shaft. Such operational condition is sometimes referred to herein as the limp home operation mode.

BRIEF DESCRIPTION OF THE DRAWINGS

FIG. 3 is a front perspective view of a propeller assembly in accordance with one embodiment of the present invention.

FIG. 4 is a rear perspective view of the propeller assembly shown in FIG. 1.

FIG. 5 is a front view of the propeller assembly shown in FIG. 1.

FIG. 6 is a rear view of the propeller assembly shown in FIG. 1.

DETAILED DESCRIPTION OF THE INVENTION

The present invention is not limited to practice in connection with a particular engine, nor is the present invention limited to practice with a particular propeller configuration. The present invention can be utilized in connection with many engines and propeller configurations. For example, a propeller having three blades is described herein. The present invention, however, can be used in connection with propellers having any number of blades. Therefore, although the invention is described below in the context of an exemplary outboard engine and propeller configuration, the invention is not limited to practice with such engine and propeller.

Figure 1:
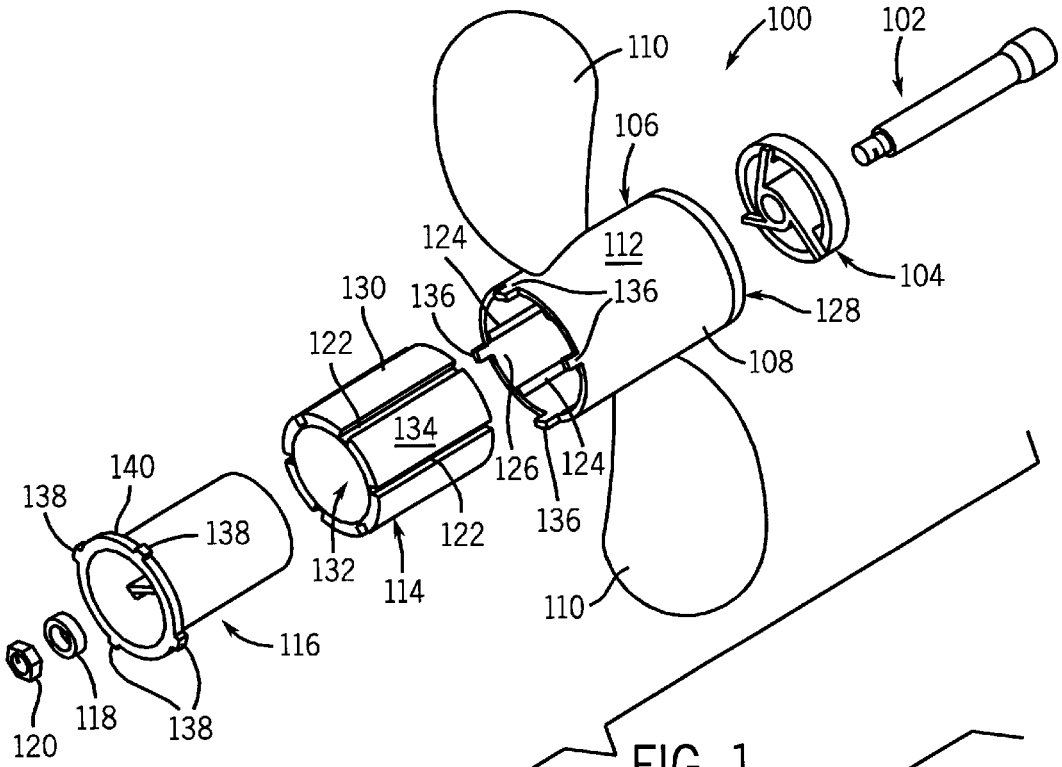
FIG. 1 is a front exploded view of the propeller assembly shown in FIG. 1.
Figure 2:
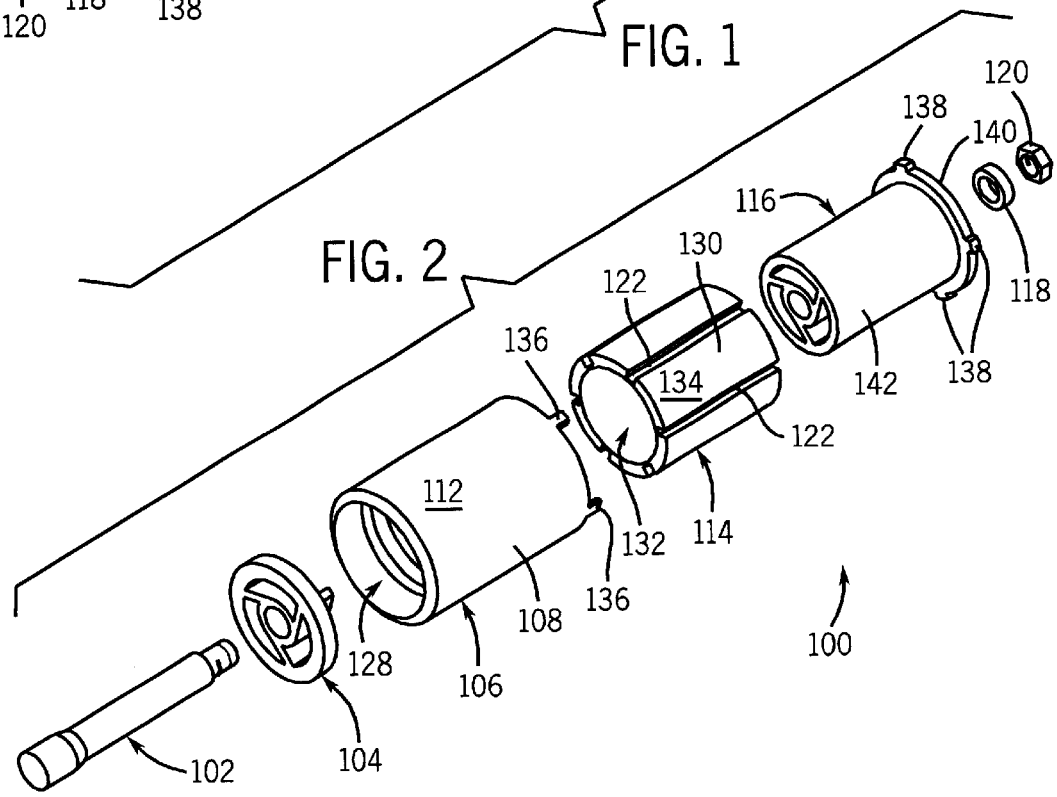
FIG. 2 is a rear exploded view of the propeller assembly shown in FIG. 3.

FIG. 1 is a front exploded view of a propeller assembly 100 in accordance with one embodiment of the present invention, and FIG. 2 is a rear exploded view of assembly 100. Propeller assembly 100 is configured for being secured to a propeller shaft 102 of a marine engine. Propeller assembly 100 includes a thrust bushing 104 and a propeller 106 having an outer hub 108 with a cylindrical shaped body. A plurality of blades 110 extend from an outer diameter hub surface 112. Assembly 100 further includes a torsion bushing 114 and an inner hub 116. A washer 118 and a nut 120 secure assembly 100 to propeller shaft 102.

Torsion bushing 114 includes a plurality of grooves 122 that mate with drive protrusions 124 that extend radially inward from an inner diameter surface 126 of outer hub 108. More specifically, a bore 128 extends through outer hub 108. Each protrusion 124 is positioned to extend within a respective one of grooves 122.

Bushing 114 includes a cylindrical shaped body 130 having a bore 132 therethrough. Grooves 122 are in an outer diameter surface 134 of cylindrical shaped body 130. Bushing 114 slides into outer hub bore 128 so that protrusions 124 are located within grooves 122. Outer hub 108 also includes a plurality of tabs 136 that, under certain operating conditions as described below in more detail, engage tabs 138 that extend from a flange 140 of inner hub 116.

Inner hub 116 slides into bore 132 of bushing 114 and is securely engaged to bushing 114, e.g., by a bonding process, such as by a vulcanizing process or other bonding process known in the art. Specifically, inner hub cylindrical shaped body 142 extends into bushing bore 132.

In the exemplary embodiment described above, propeller shaft 102 is fabricated from steel, thrust bushing 104 is stainless steel, propeller 106 is stainless steel, torsion bushing 114 is a plastic, e.g., urethane, and inner hub 116 is stainless steel. Of course, such components can be fabricated from other materials, e.g., brass, aluminum, selected depending upon the desired operating characteristics of assembly 100.

FIG. 3 is a front perspective view of propeller assembly 100, and FIG. 4 is a rear perspective view of assembly 100. Generally, propeller assembly 100 rotates with propeller shaft 102 during normal operations. In the event of an impact, e.g., propeller 106 strikes an object in the water, propeller 106 may rotate relative to shaft 102. Specifically, in the exemplary embodiment, since torsion bushing 114 is plastic and outer hub 108 is stainless steel, outer hub 108 may rotate relative to bushing 114 as described below.

In the event that such relative rotation of propeller 106 results in shearing the engagement between propeller 106 and torsion bushing 114, a limp home arrangement provides that propeller 106 may still be rotatable with propeller shaft 102 so that the operator can at least reach a dock for repairs. The limp home arrangement includes outer hub tabs 136 and inner hub tabs 138. Once propeller outer hub 108 rotates so that outer hub tabs 136 engage inner hub tabs 138, outer hub 108 once again rotates with propeller shaft 102. Such operational condition is sometimes referred to herein as the limp home operation mode.

FIG. 5 is a front view of assembly 100, and FIG. 6 is a rear view of assembly 100. As shown in FIG. 5, inner hub 116 includes a central shaft supporting sleeve 144 having a bore 146 therethrough, and support ribs 148' extend from sleeve 144 to an inner wall 150 of hub 116. Propeller shaft 102 extends through bore 146.

As shown in FIG. 6, nut 120 is tightened to shaft 102 and engages shaft 102 to propeller 106. As a result, propeller 106 rotates with shaft 102 during normal engine operations. Also, in an initial operative position, outer hub tabs 136 are radially spaced from inner hub tabs 138. In the event propeller 106 rotates relative to inner hub 116, e.g., upon an impact with an object in the water, then such relative rotation may continue until tabs 136 and 138 are in contact. Once tabs 136 and 138 are in contact, propeller 106 once again rotates with inner hub 116 and propeller shaft 102, i.e., the limp home operation mode.

Figure 7:
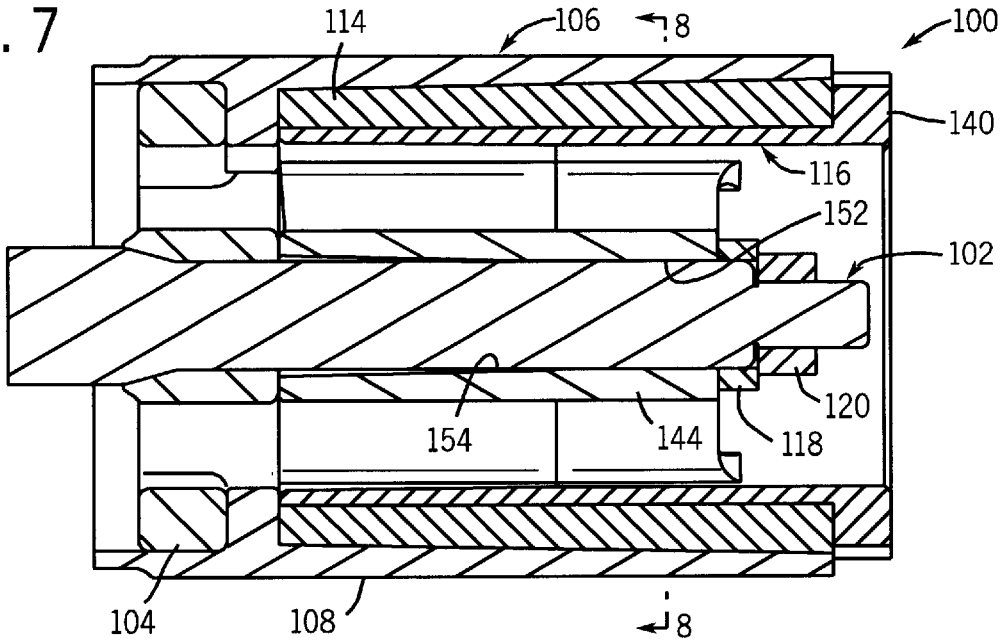
FIG. 7 is a cross-sectional view through line 7—7 shown in FIG. 5.

FIG. 7 is a cross-sectional view through line 7—7 shown in FIG. 5. As shown in FIG. 7, torsion bushing 114 is tapered which facilitates secure engagement between bushing 114 and outer hub 108. In addition, and although not shown in FIG. 7, propeller shaft 102 has longitudinal splines that extend from an end 152 of shaft 102. The propeller shaft splines mate with grooves in an inner diameter surface 154 of sleeve 144 and facilitate secure engagement between inner hub 114 and propeller shaft 102.

Figure 8:
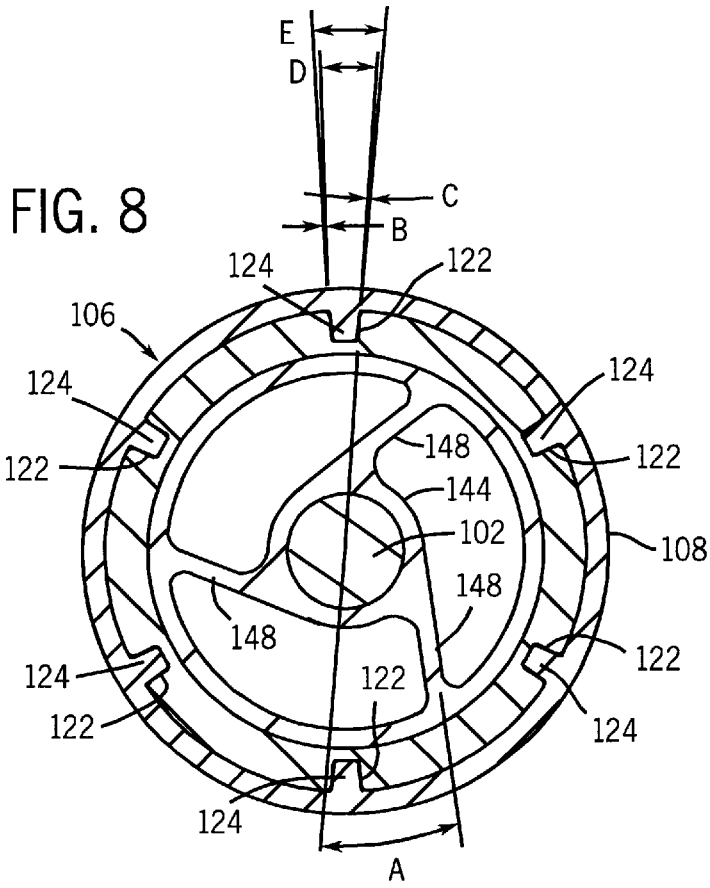
FIG. 8 is a cross-sectional view through line 8—8 shown in FIG. 7.

FIG. 8 is a cross-sectional view through line 8—8 shown in FIG. 7. As shown in FIG. 8, protrusions 124 extend into grooves 122 in bushing 114. Angles A, B, C, D, and E, in the exemplary embodiment, are as set forth below subject to manufacturing tolerances.

Angle A as illustrated in FIG. 8 is an angle between a first side of bushing groove 122 and an edge of an inner hub support rib 148. In an illustrative embodiment Angle A is about 12.8°.

Angle B as illustrated in FIG. 8 is an angular difference between a first side of a bushing grove 122 and a first side of one of the outer hub protrusions 124. In an illustrative embodiment Angle B is approximately 0.0181pi radians (approximately 1.04°).

Angle C as illustrated in FIG. 8 is an angular difference between a second side of a bushing grove 122 and a second side of one of the outer hub protrusions 124. In an illustrative embodiment Angle C is approximately 0.0181 pi radians (approximately 1.04°).

Angle D as illustrated in FIG. 8 is an angular difference between a first side of one of the outer hub protrusions 124 and a second side of the outer hub protrusion 124. In an illustrative embodiment Angle C is approximately 7.0°.

Angle E as illustrated in FIG. 8 is an angular difference between a first side of a bushing grove 122 and a second side the bushing groove 122. In an illustrative embodiment Angle E is approximately 8.5°.

Upon the occurrence of an impact, inner hub 116 continues to rotate with propeller shaft 102. In the event that sufficient force is present, protrusions 124 shear which results in propeller shaft 102 rotating relative to propeller 106. If the forces are not sufficient to also shear limp home tabs 136 and 138, then propeller 106 will resume rotating with propeller shaft 102.

Different inner hub and torsion bushing combinations can be used with one propeller so that one propeller can be utilized on many different types of marine engines. For example, one particular marine engine may have splines on the propeller shaft of a first length, and another particular marine engine may have splines on a propeller shaft of a second length, or a different number of splines or different size splines. Different inner hubs having sleeves with different length splines can be provided. Although different inner hub and torsion bushings are utilized, a same propeller can be used. That is, by providing interchangeable inner hub and torsion bushing sub-assemblies, one propeller can be used in conjunction with many different type engines.

It is contemplated that inner hub and torsion busing bushing subassemblies could be sold in kit form. For example, different kits containing different sub-assemblies specified for particular engine types could be provided. In one specific embodiment, a kit includes at least one such sub-assembly and a propeller that can be used with sub-assembly included in the kit as well as with other subassemblies.

From the preceding description of various embodiments of the present invention, it is evident that the objectives of the invention are attained. Although the invention has been described and illustrated in detail, it is to be clearly understood that the same is intended by way of illustration and example only and is not to be taken by way of limitation. Accordingly, the spirit and scope of the invention are to be limited only by the terms of the appended claims.

What is claimed is:

1. A propeller assembly for being secured to a propeller shaft of a marine engine, said propeller assembly comprising:

a bushing comprising a cylindrical shaped body having a bore therethrough;

an inner hub comprising a cylindrical shaped body sized to extend into said bushing bore and at least one tab extending therefrom;

a propeller comprising an outer hub comprising a cylindrical shaped body, a plurality of blades extending from an outer diameter surface of said outer hub body; and at least one limp home tab radially extending from a side of the outer hub in the axial direction.

2. A propeller assembly in accordance with claim 1 wherein said bushing and said inner hub are secured together.

3. A propeller assembly in accordance with claim 2 wherein said bushing and said inner hub are secured together by a bonding process.

4. A propeller assembly in accordance with claim 1 wherein said bushing is fabricated from plastic.

5. A propeller assembly in accordance with claim 1, said bushing comprising a plurality of grooves in an outer diameter surface of said cylindrical shaped body.

6. A propeller assembly in accordance with claim 5 wherein an inner diameter surface of said outer hub body comprises a plurality of protrusions extending radially inward, each said protrusion positioned to extend within a respective one of said grooves in said outer diameter surface of said bushing body.

7. A propeller assembly in accordance with claim 1, said inner hub comprising a flange at one end of said inner hub body, and at least one tab extending therefrom.

8. An interchangeable bushing and inner hub subassembly for a propeller assembly to secure a propeller to a propeller shaft, said subassembly comprising a bushing comprising a cylindrical shaped body having a bore therethrough, and an inner hub comprising a cylindrical shaped body sized to extend into said bushing bore, wherein the cylindrical shaped body of the inner hub is sized such that upon positioning of the inner hub within the bushing, the body of the inner hub extends at least an entire length of the body of the bushing; and at least one tab extending radially outwardly from an end of said inner hub body.

9. A subassembly in accordance with claim 8 wherein said bushing and said inner hub are secured together.

10. A subassembly in accordance with claim 9 wherein said bushing and said inner hub are secured together by a bonding process.

11. A subassembly in accordance with claim 8 wherein said bushing is fabricated from plastic.

12. A subassembly in accordance with claim 8 wherein said inner hub further comprising a sleeve having a bore therethrough, a plurality of grooves in an inner diameter surface of said sleeve configured to mate with splines extending from an outer diameter surface of the propeller shaft.

13. A subassembly in accordance with claim 12 wherein a longitudinal length of said grooves in said inner diameter surface of said sleeve is selected based on a length of the splines extending from the outer diameter surface of the propeller shaft.

14. An interchangeable bushing and inner hub assembly in accordance with claim 8, said bushing comprising a plurality of grooves in an outer diameter surface of said bushing cylindrical shaped body.

15. An interchangeable bushing and inner hub assembly in accordance with claim 8, said inner hub body comprising a flange at one end thereof, said at least one tab extending from said flange.

16. A kit for securing a propeller to a propeller shaft of a marine engine, said kit comprising:

a bushing comprising a cylindrical shaped body having a bore therethrough, and an inner hub comprising a cylindrical shaped body sized to extend into said bushing bore such that the cylindrical body of the inner hub extends past the cylindrical body of the bushing, said inner hub comprising a flange at one end of said inner hub body, and at least one tab radially extending from said flange.

17. A kit in accordance with claim 16 wherein the cylindrical shaped body of the inner hub comprises a plurality of grooves in an outer diameter surface.

18. A kit assembly in accordance with claim 16 wherein said bushing and said inner hub are secured together.

19. A kit in accordance with claim 18 wherein said bushing and said inner hub are secured together by a bonding process.

20. A kit in accordance with claim 16 wherein said bushing is fabricated from plastic.

21. A propeller assembly for being secured to a propeller shaft of a marine engine, said propeller assembly comprising:

means for engaging the propeller shaft;

a propeller comprising an outer hub comprising a cylindrical shaped body, and a plurality of blades extending from an outer diameter surface of said outer hub body, a bore extending through said propeller, and a plurality of protrusions extending radially inward from an inner diameter surface of said outer hub body;

means intermediate said propeller shaft engaging means and said propeller, said intermediate means secured to said engaging means, said intermediate means comprising a plurality of grooves that mate with said plurality of protrusions; and at least one limp home tab extending from a side of the outer hub in the axial direction.

22. A propeller assembly in accordance with claim 21 wherein said engaging means comprises an inner hub comprising a cylindrical shaped body, a flange at one end of said inner hub body, and at least one tab extending from said flange.

23. A propeller assembly in accordance with claim 22 wherein said intermediate means comprises a bushing comprising a cylindrical shaped body have a bore therethrough, said plurality of grooves in an outer diameter surface of said cylindrical shaped body.

24. A propeller assembly in accordance with claim 21 wherein said engaging means and said intermediate means secured together by a bonding process.

25. A propeller assembly in accordance with claim 21 wherein said intermediate means is fabricated from plastic.

26. A propeller assembly for being secured to a propeller shaft of a marine engine, said propeller assembly comprising:

an inner hub comprising a cylindrical shaped body, a flange at one end of said inner hub body, and at least one tab extending from said flange;

a propeller comprising an outer hub comprising a cylindrical shaped body, a plurality of blades extending from an outer diameter surface of said outer hub body, an inner diameter surface of said outer hub body having a plurality of protrusions extending radially inward and, at least one limp home tab, an engagement member for coupling said propeller to said inner hub and causing said propeller and said hub to rotate together, said limp home tab configured to engage said at least one tab of said flange and rotate said propeller when said engagement member fails.

27. A propeller assembly in accordance with claim 26 said engagement member comprises a torsion bushing.

28. A propeller assembly in accordance with claim 27 wherein said torsion bushing comprises a cylindrical shaped body having a bore therethrough, and a plurality of grooves in an outer diameter surface of said cylindrical shaped body.

29. A propeller assembly in accordance with claim 28, each said outer hub body protrusion positioned to extend within a respective one of said grooves in said outer diameter surface of said bushing body.

30. A propeller assembly in accordance with claim 29 wherein said bushing is bonded to said inner hub.

31. An interchangeable bushing and inner hub subassembly for a propeller assembly to secure a propeller to a propeller shaft, said subassembly comprising a bushing comprising a cylindrical shaped body having a bore therethrough, and an inner hub comprising a cylindrical shaped body sized to extend into said bushing bore and at least one tab extending radially outwardly from an end of said inner hub body; and wherein said inner hub further comprises a sleeve having a bore therethrough, a plurality of grooves in an inner diameter surface of said sleeve configured to mate with splines extending from an outer diameter surface of the propeller shaft.

32. A subassembly in accordance with claim 31 wherein a longitudinal length of said grooves in said inner diameter surface of said sleeve is selected based on a length of the splines extending from the outer diameter surface of the propeller shaft.

* * * * *